United States Patent [19]

Thomas et al.

[11] 4,384,825

[45] May 24, 1983

[54] PERSONAL SAMPLING PUMP

[75] Inventors: Thomas J. Thomas, Lewisburg, W. Va.; Richard H. Mills, Largo, Fla.

[73] Assignee: The Bendix Corporation, Southfield, Mich.

[21] Appl. No.: 202,556

[22] Filed: Oct. 31, 1980

[51] Int. Cl.[3] ..... F04B 49/06

[52] U.S. Cl. ..... 417/22; 318/313; 417/42; 417/45; 417/63

[58] Field of Search ..... 318/312, 313; 417/43, 417/18, 20, 22, 44, 45, 23, 24, 63, 234, 42

[56] References Cited

U.S. PATENT DOCUMENTS

| | | | |
|---|---|---|---|
| 978,167 | 12/1910 | Kelsey . | |
| 2,877,715 | 3/1959 | Rittenhouse | 103/150 |
| 3,015,281 | 1/1962 | Umholz | 103/118 |
| 3,295,359 | 1/1967 | Peck | 73/28 |
| 3,410,059 | 11/1968 | Garnier | 55/270 |
| 4,024,864 | 5/1977 | Davies et al. | 417/20 X |
| 4,063,824 | 12/1977 | Baker et al. | 417/43 |
| 4,123,932 | 11/1978 | Baker et al. | 73/28 |
| 4,145,161 | 3/1979 | Skinner | 417/22 |
| 4,221,543 | 9/1980 | Cosentino et al. | 417/22 |
| 4,257,746 | 3/1981 | Wells | 417/43 |

*Primary Examiner*—Edward K. Look

*Attorney, Agent, or Firm*—Bruce L. Lamb; W. G. Christoforo

[57] ABSTRACT

A portable battery powered pump providing constant mass flow of air sample through a particular filter or vapor trap in which the pump drive motor speed is controlled by an amplifier having a reference voltage input and an inverse feedback signal related to sensed motor speed. Compensation for increased resistance to air sample flow is made by a motor current feedback signal applied to the amplifier to cause motor speed to increase with increased flow resistance.

10 Claims, 2 Drawing Figures

PERSONAL SAMPLING PUMP

Figure 2:
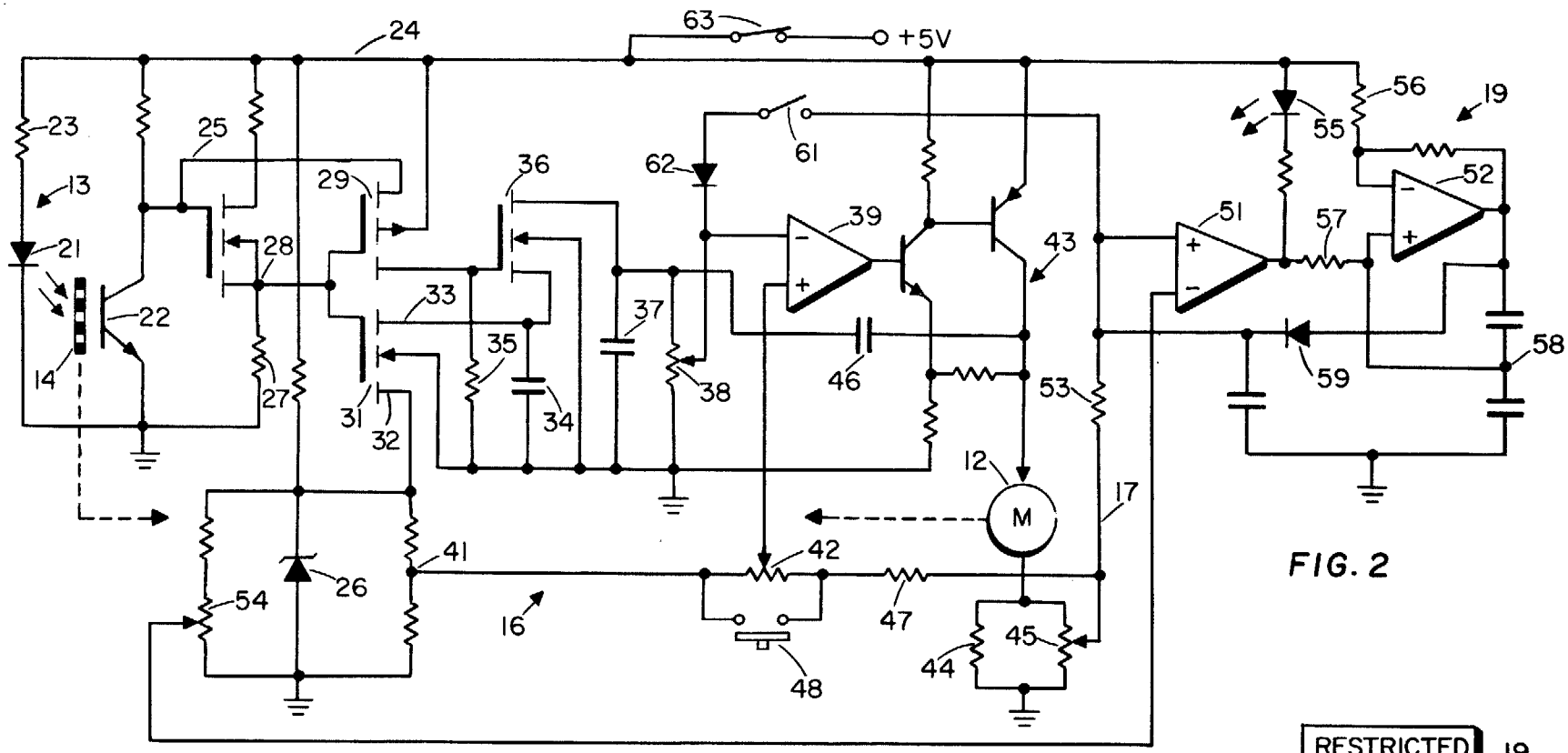

The present invention relates to personal sampling pumps. More particularly, it relates to a control circuit for a pump drive motor for maintaining constant mass flow pumping capacity and for indicating an excess motor load condition.

Personal sampling pumps are small battery operated vacuum pumps intended to be worn on the person to monitor the exposure of the wearer to hazardous atmospheric conditions. Typically such pumps are designed to aspirate a constant air mass flow through a collection device such as a particulate filter or a vapor absorption tube during the entire time the wearer is exposed to possibly hazardous conditions. After exposure the contents of the collection device are analyzed to determine the identity and concentration of hazardous substances which may have been present. Obviously such determinations are invalid if constant air mass flow through the sample collector is not maintained.

One example of a prior personal sampling pump having control means for constant air flow is found in U.S. Pat. No. 4,063,824 issued Dec. 20, 1977 to Baker et al for "Chemical Dosimeter Having a Constant Flow Air Sampling Pump". In the dosimeter disclosed in the Baker et al patent air is pumped through a calibrated orifice across which a sensitive differential pressue switch is positioned. The pressure switch closes upon the occurrence of a low pressure drop across the orifice, applying a fixed bias to an integrator circuit. The integrator output gradually increases causing a corresponding increase in the pump motor speed and attendant air flow until the orifice pressure drop becomes excessive. Excessive orifice pressure drop opens the switch, causing the integrator output to gradually decrease, along with pump speed and air flow, until the low orifice pressure drop state is reached, whereupon the cycle is repeated. The air flow in the Baker et al dosimeter appears to vary continuously between high and low levels with the average air flow, presumably, remaining constant.

Sensitive pressure switches, as required in the Baker et al dosimeter, occupy substantial space in a housing which is desirably as compact as possible. Moreover, such switches are expensive to produce and the fixed pump load, imposed by the calibrated orifice with which the pressure switch is associated, is wasteful of battery power.

It is an object of the present invention to provide a control circuit for a personal sampling pump which will maintain constant air mass flow through a sample collector.

It is another object of the invention to provide a control circuit for a personal sampling pump which will continuously maintain constant the short-term air mass flow rather than the long-term average mass flow.

It is a further object of the invention to improve the efficiency and reliability of a personal sampling pump, as well as reduce the cost and bulk by eliminating delicate mechanical components, such as a sensitive pressure switch, from the control circuit thereof.

Another object of the invention is to provide simplified means for indicating stoppage of air flow through the sample collector of a personal sampling pump.

Briefly, the invention comprises a speed control circuit for a battery powered motor driven pump in which the motor speed is directly measured by a photo-optical chopper driven by the motor to provide a motor speed signal. The motor speed signal is compared with a reference signal and the resulting difference signal, i.e. the speed error signal, controls an amplifier, in inverse feedback fashion, which supplies power to the motor. The speed error signal is combined with a signal related to motor current to compensate for variations in motor load. The motor current signal is also used in a circuit for indicating excess restriction in the flow of sample air.

Figure 1:
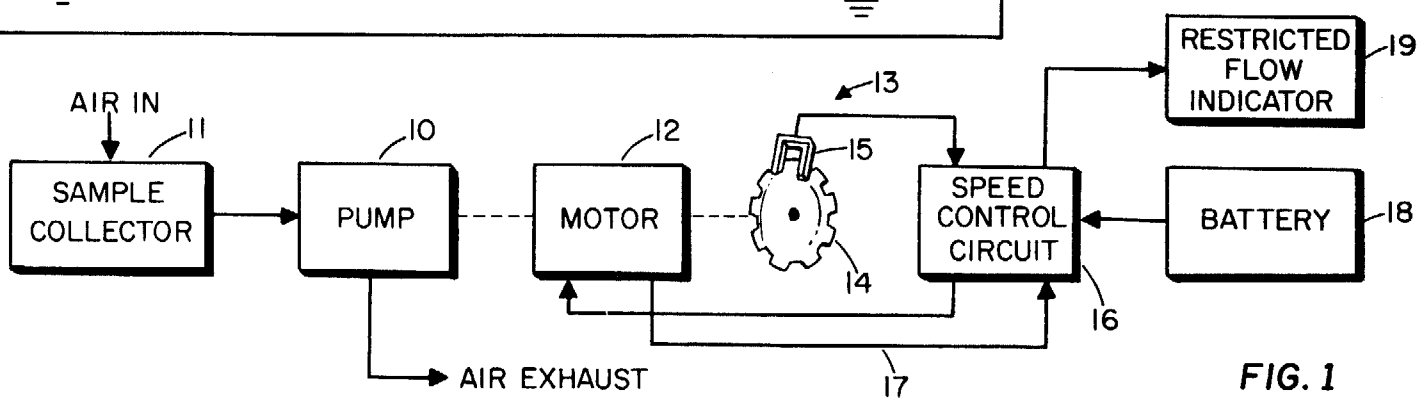

In the drawings:

FIG. 1 is a simplified functional block diagram of the sampling pump of the invention; and FIG. 2 is schematic diagram of the motor speed control and restricted flow indicator of the invention.

Referring to FIG. 1, the inlet to a pump 10, preferably a diaphragm type, is connected by flexible tubing to a sample collector 11. If exposure to dust is being monitored, collector 11 may comprise a cassette having inlet and outlet orifices and containing filter media for trapping the particulates entrained in the air stream induced therethrough by the pump vaccum. If exposure to noxious vapors is being monitored, the sample collector may be a small column packed with an absorbent material, such as charcoal, through which air is drawn by the pump. Other collector devices may, of course, be used. At the end of the exposure period the sample collector is removed from the pump and the substances trapped therein are analyzed by various known methods to determine the level of exposure of the pump wearer to hazardous substances. Obviously, the validity of a determination of exposure level based upon measurement of mass or volume of collected sample at the end of an exposure period depends upon maintenance of a constant sample air mass flow throughout the exposure period. Since resistance to air flow through the sample collector may increase as exposure time increases due to accumulated particulates, continuous control of the speed of the pump drive motor is required.

The speed of the motor 12, driving pump 10, is continuously monitored by a photo-optical device 13 which includes a light chopper 14, coupled to the drive shaft of motor 12, and a photo source-sensor assembly 15. The device 13 produces a square wave having a frequency proportional to motor speed. A speed control circuit 16 receives the signal from device 13 in a frequency to voltage converter which produces a signal having a magnitude proportional to the speed of motor 12. The latter speed signal is compared with a reference voltage and the difference between the compared voltages, constituting a speed error signal, is combined with a motor current feedback signal, received over line 17, in a high gain amplifier driving a power amplifier. The power amplifier controls the power supplied by a battery 18 to motor 12.

If the resistance to sample air flow through the collector 12 increases, the density of the pumped air decreases, and if no increase in the volume air flow then occurs, the air mass flow will have decreased. To maintain air mass flow constant it is therefore necessary to increase the pump motor speed and, hence, volume air flow, as resistance to air flow increases. The motor current feedback signal on line 17 is proportional to the motor torque output and is consequently indicative of the flow resistance burdening the pump. The motor current signal is combined with the motor speed error signal in such manner as to cause an increase in motor speed as air flow resistance increases, thereby maintaining air mass flow constant.

The motor current feedback signal also serves to actuate a restricted flow indicator 19 whenever the magnitude of the current feedback signal reaches a level indicative of pump overload.

The speed control circuit 16 and restricted flow indicator 19 will now be described in detail with reference to FIG. 2.

In FIG. 2, the photo-optical speed measuring device 13 is shown schematically as comprising a light emitting diode 21 opposing a photo transistor 22 with the chopper wheel 14 interposed therebetwen to periodically interrupt transmission of light from diode 21 to transistor 22. Source-sensor devices which combine diode 21 and transistor 22 in a U-shaped module are produced commercially by the General Electric Company as type GE H22A5 and by Texas Instruments as type TIL138. LED 21 is connected through a current limiting resistor 23 to the B+line 24 for continuous energization. Chopper wheel 14 is mechanically coupled to motor 12 for rotation at a rate proportional to motor speed. Rotation of chopper wheel 14 periodically interrupts transmission of light from diode 21 to photo transistor 22 rendering the transistor nonconductive on interruption of the light. The wave form at the collector of transistor 22 is substantially a square wave. The square wave from the collector of transistor 22 is applied to the gate of a CMOS field effect transistor 25 causing transistor 25 to conduct during periods of nonconduction of transistor 22. The source of reference voltage is provided by a Zener diode 26 connected through a regulating resistor 27 to bus 24. A connection from the source electrode 28 to the gate electrodes of FETs 29 and 31 applies a positive voltage to those gates whenever FET 25 is conductive. A positive voltage at the gate of FET 31 allows conduction from the source 32 through the drain 33 thereof to charge a storage capacitor 34 to the reference voltage level appearing at the cathode of diode 26. FET 31 is of the N-channel type and is conductive only during the positive half-cycles of the square wave appearing at source 28 while during the same positive half-cycles FET 29, of the P-channel type, is nonconductive. During the alternate, or zero-level, half-cycles of the square wave FET 29 conducts thereby developing across resistor 35 a positive-going square wave of opposite phase to the square wave at source 28. This opposite phase square wave is applied to the gate of an FET 36 of the N-channel type enabling the transistor to conduct during such times as the gate voltage thereof is positive. Connections are made from storage capacitor 34 to the source electrode of FET 36 and from the drain electrode thereof to a second storage capacitor 37. FETs 33 and 36 are rendered conductive and nonconductive in alternation by the oppositely phased square waves applied to the gates thereof. During the half-cycle of conduction of FET 33, capacitor 34 will receive a charge equal to the product of the value of capacitor 34 and the reference voltage supplied by diode 26. During the half-cycle of nonconduction of FET 33 and nonconduction of FET 36, capacitor 34 is isolated from the reference voltage source and an increment of the charge contained thereon is transferred through FET 36 to capacitor 37. Each increment of charge transferred to capacitor 37 causes the voltage thereacross to rise incrementally. The greater the number of increments of charge received by capacitor 37 in unit time the greater will be the voltage appearing thereacross. Consequently the voltage at capacitor 37 is directly related to the frequency of the square wave at the collector of transistor 22 and that frequency is directly related to the speed of motor 12.

A portion of the speed related voltage of capacitor 37, taken from potentiometer 38 is applied to the inverting input of an operational amplifier 39. A voltage divider 41 is connected across diode 26 to provide a constant reference voltage through potentiometer 42 to the noninverting input of amplifier 39. The output of amplifier 39 controls a power amplifier 43 which furnishes a controlled amount of power from the battery bus 24 to the motor 12. A comparatively low-value resistor 44 is connected in series with the ground return line of motor 12 to develop a voltage thereacross proportional to motor current. An adjustable amount of the motor current signal taken from a potentiometer 45 is fed back to the noninverting input of amplifier 39 through potentiometer 42. Feedback capacitor 46 connected from power amplifier 43 to the inverting input of amplifier 39 through potentiometer 38 smoothes the voltage applied to motor 12 and holds the output applied by amplifier 39 to amplifier 43 at the level existing when the inputs of amplifier 39 are nulled.

The output of amplifier 39 is the highly amplified difference between the reference voltage applied to the noninverting input thereof and the motor speed signal applied to the inverted input thereof. Should the motor speed signal exceed the reference voltage, the output of amplifier 39 is reduced, causing a decrease in the power furnished motor 12 by amplifier 43 and consequent reduction in motor speed until the motor speed signal and the reference voltage at the inputs to amplifier 39 are at a null. Conversely if the motor speed drops below the desired value, the reference voltage input in amplifier 39 exceeds the motor speed signal input, increasing the output of amplifier 39 and the power applied to the motor until the selected speed is restored. Should the resistance to air flow through the sample collector increase, the power necessary for the motor to maintain the initially selected speed will increase and such power increase is indicated by an increase in the voltage drop across resistor 44. The increased voltage drop of resistor 44 raises the voltage level of line 17 and the voltage on line 17 added, through resistor 47, to the reference voltage applied to potentiometer 42 causes an increase in the voltage applied to the noninverting input of amplifier 39. The result of such increase is to require an increase in the motor speed signal above the initially selected value for null of the inputs to amplifier 39. Such increase in the initially selected motor speed compensates for the reduced density of sample air flow occasioned by the increase of pressure drop across the sample collector, thereby maintaining the mass flow of sample air constant. An explanation of the pump calibration procedure will bring out this operation of the invention more clearly.

For calibration, sample collector 11 is replaced by a flow meter having an adjustable inlet restriction. Pressure drop across the flow meter is measured by a manometer connected in the line between the flow meter and pump inlet. With the pump running, the inlet restrictor is adjusted to produce a pressure drop of 3 inches water column. Calibration switch 48 is closed to eliminate the effect of motor current feedback signal on line 17 and potentiometer 38 is adjusted to achieve a selected flow rate of from one to three liters per minute. Switch 48 is then opened and potentiometer 45 is adjusted to maintain the selected flow rate at 3 inches w.c. Next the restrictor is adjusted to produce a manometer indication of 15 inches w.c. and potentiometer 42 is adjusted to restore the flow rate selected at 3 inches w.c. pressure. This procedure insures that the proper amount of motor current feedback signal will be added to the reference voltage to maintain sample air mass flow constant through a range of resistance to sample air flow corresponding to pressure drops of between 3 and 15 inches w.c.

Restricted flow indicator 19, which includes operational amplifiers 51 and 52, provides a visual indication to the pump wearer of proper operation within the pump capacity. The motor current feedback signal on line 17 is applied through resistor 53 to the noninverting input of amplifier 51 and an adjustable reference voltage, taken from potentiometer 54 connected across diode 26, is applied to the inverting input of amplifier 51. As long as the voltage on the inverting input is greater than the voltage on the noninverting input, the output of amplifier 51 will remain low. A light emitting diode 55, visible to the pump wearer, is connected between bus 24 and the output of amplifier 51. LED 55 will be energized as long as the output of amplifier 51 remains low. The reference voltage from potentiometer 54 is adjusted so that the output of amplifier 51 will be on the verge of swinging high when the motor current feedback signal on line 17 is of a value corresponding to a 15 inch w.c. pressure drop across the sample collector. A restriction creating a greater pressure drop than the 15 inch value causes the output of amplifier 51 to swing high and extinguish the illumination of diode 55.

Operational amplifier 52 provides a latch for maintaining diode 55 extinguished if an excess restriction persists for more than about 10 seconds. If desired, the latch can also cause power to be removed from the pump motor. Voltage from bus 24 applied to the inverting input of amplifier 52 through resistor 56 tends to maintain the output of amplifier 52 low. The output of amplifier 51, connected through resistor 57, when low, does not tend to reverse the low output condition of amplifier 52. When the output of amplifier 51 swings high the output of amplifier 52 begins to increase and a charge will commence to accumulate on capacitive divider 58. After a time, which is determined by the values of the circuit constants of amplifier 52 and which is desirably 10 seconds, sufficient charge will be accumulated on divider 58 to cause the output of amplifier 52 to swing high. The high output condition of amplifier 52 is fed back positively through diode 59 to the noninverting input of amplifier 51 thereby causing both the output of amplifier 51 and the output of amplifier 52 to be latched in a high condition until such time as battery power is removed from bus 24 by opening switch 63. During all the time the outputs of amplifiers 51 and 52 are latched high, diode 55 will remain unilluminated indicating that the sampling operation is not valid.

If desired, the restricted flow indicator can also cause power to be removed from the pump motor. To accomplish this, a connection is made from the noninverting input of amplifier 51 through switch 61 and diode 62 to the inverting input of amplifier 39. When switch 61 is closed and the output of amplifier 52 is latched high, the noninverting input of amplifier 51 is likewise high. The inverting input of amplifier 39 will then be forced high and the resulting low output of amplifier 39 will bias power amplifier 43 into nonconduction, thereby removing power from the motor 12.

The invention claimed is:

1. In a personal sampling pump adapted to be worn on the person for collecting over an extended period of time a sample of atmospheric pollutants to which the pump wearer may be exposed, including a sample collector for trapping pollutants present in the air, a pump for establishing air flow through said sample collector, a motor for driving said pump and a power source for said pump;

means for controlling said motor to maintain constant air mass flow through said collector, comprising motor speed sensing means producing a signal proportional to the speed of said motor;

a source of reference voltage;

an amplifier for controlling the amount of power supplied by said power source to said motor;

amplifier control means having said motor speed signal and said reference voltage as inputs and for controlling said amplifier in accordance with the difference between said inputs in a sense to cause an increase in the power supplied to said motor when said reference voltage exceeds said motor speed signal and a decrease in the power supplied to said motor when said motor speed signal exceeds said reference voltage;

means providing a motor load signal proportional to the mechanical load of said pump on said motor; and means applying said motor load signal to said amplifier control means in such sense that an increase in said motor load signal causes an increase in the power supplied to said motor.

2. The apparatus of claim 1, with additionally, means for determining an excess condition of said motor load signal; and means for alerting the pump wearer to the existence of said excess motor load signal.

3. The apparatus of claim 2 wherein said motor speed sensing means produces a signal having a frequency proportional to the speed of said motor and with additionally, a frequency to voltage converter receiving said signal from said sensing means and providing an output voltage having a magnitude proportional to the speed of said motor, said converter output constituting said motor speed signal.

4. The apparatus of claim 3 wherein said frequency to voltage converter comprises a first storage capacitor;

a second storage capacitor;

means for applying a charge to said first storage capacitor during a first phase of said motor speed sensing means signal; and means for transferring charge from said first capacitor to said second capacitor during a second phase of said motor speed sensing means signal, the voltage to which said second capacitor is thereby charged being the output of said frequency to voltage converter.

5. The apparatus of claim 1 wherein said means providing a motor load signal comprises means responsive to the current drawn by said motor from said power source and producing a signal proportional to said current.

6. In a personal sampling pump adapted to be worn on the person for collecting over an extended period of time a sample of atmospheric pollutants to which the pump wearer may be exposed, including a sample collector for trapping pollutants present in the air, a pump for establishing air flow through said sample collector, a motor for driving said pump and a power source for said pump;

means for controlling said motor to maintain constant air mass flow through said collector, comprising photo optical motor speed sensing means including a light source, a photo sensitive detector positioned to detect light from said source and a light chopper coupled to said motor for interrupting light from said source to said detector at a rate proportional to the speed of said motor, said detector producing a signal having a frequency proportional to the speed of said motor;

a frequency to voltage converter receiving said detector signal and producing an output voltage having a magnitude proportional to the frequency of said detector signal;

a source of reference voltage;

an amplifier for controlling the amount of power supplied by said power source to said motor;

amplifier control means having the output of said converter and said reference voltage as inputs and for controlling said amplifier in accordance with the difference between said inputs in a sense to cause an increase in the power supplied to said motor when said reference voltage exceeds said converter output and a decrease in the power supplied to said motor when said converter output exceeds said reference voltage;

means providing a motor load signal proportional to the mechanical load of said pump on said motor; and means applying said motor load signal to said amplifier control means in such sense that an increase in said motor load signal causes an increase in the power supplied to said motor.

7. The apparatus of claim 6 with additionally, means producing a signal having the same frequency as said detector signal but of opposite phase, both said detector signal and said opposite phase signal being applied to said frequency to voltage converter to produce said output voltage having a magnitude proportional to frequency.

8. The apparatus of claim 7 wherein said frequency to voltage converter comprises a first storage capacitor;

a source of constant voltage;

a first transistor connected to conduct current from said constant voltage source to said first storage capacitor during one phase of signal from said detector;

a second storage capacitor; and a second transistor connected to conduct current from said first storage capacitor to said second storage capacitor during said opposite phase of signal from said detector, the voltage to which said second capacitor is thereby charged being the output of said frequency to voltage converter.

9. The apparatus of claim 6 with additionally, means providing a fixed voltage corresponding to an excess motor load signal;

a comparator circuit to which said fixed voltage and said motor load signal are applied, the output of said comparator circuit being of a first logic state when said fixed voltage exceeds said motor load signal and of a second state when said motor load signal exceeds said fixed voltage; and means for visually signaling to the wearer of said pump the logic state of said comparator.

10. The apparatus of claim 9, with additionally, means for latching said comparator output in said second state after said comparator output has persisted in said second state for a predetermined time.

* * * * *